US006652225B2

(12) United States Patent
Esa

(10) Patent No.: US 6,652,225 B2
(45) Date of Patent: Nov. 25, 2003

(54) FAN WITH INTEGRATED FAN MOTOR

(75) Inventor: Hannu Esa, Vantaa (FI)

(73) Assignee: Voith Paper Patent GmbH, Heidenheim (DE)

( * ) Notice: Subject to any disclaimer, the term of this patent is extended or adjusted under 35 U.S.C. 154(b) by 54 days.

(21) Appl. No.: 10/085,893

(22) Filed: Feb. 28, 2002

(65) Prior Publication Data

US 2002/0122720 A1 Sep. 5, 2002

(30) Foreign Application Priority Data

Mar. 3, 2001 (DE) ..... 101 10 400

(51) Int. Cl.[7] ..... F04D 29/56

(52) U.S. Cl. ..... 415/159; 415/167; 415/220; 417/408

(58) Field of Search ..... 415/220, 159, 415/167; 417/406, 408

(56) References Cited

U.S. PATENT DOCUMENTS

| | | | | |
|---|---|---|---|---|
| 2,971,333 A | | 2/1961 | Mendelsohn et al. | 60/39.14 |
| 3,904,324 A | | 9/1975 | Flatt et al. | 417/355 |
| 4,232,991 A | | 11/1980 | Gamell | 415/90 |
| 5,120,194 A | | 6/1992 | Nichols | 415/167 |
| 5,275,533 A | | 1/1994 | Kapich | 415/202 |
| 5,427,508 A | | 6/1995 | Kapich | 417/374 |
| 6,457,955 B1 | * | 10/2002 | Cheng | 417/423.8 |

FOREIGN PATENT DOCUMENTS

| | | | |
|---|---|---|---|
| DE | CH 56208 | 3/1912 | |
| DE | 200 12 843 U1 | 11/2000 | F04D/29/00 |
| WO | WO 90/08880 | 8/1990 | F01D/9/02 |

* cited by examiner

*Primary Examiner*—Edward K. Look
*Assistant Examiner*—Kimya N McCoy
(74) *Attorney, Agent, or Firm*—Taylor & Aust, P.C.

(57) ABSTRACT

The revolving fan impeller of a fan includes a fan blade ring, which is used to produce an air current, as well as a turbine blade ring, which is used to drive the impeller and which may be impinged upon by a pressurized fluid. The fan casing includes a feed channel for the pressurized fluid as well as several nozzles to carry the pressurized fluid from the feed channel to the turbine blade ring. The number of active nozzles may be varied. For this purpose, the nozzles are arranged on a stator ring, which may be rotated around the fan axis.

19 Claims, 3 Drawing Sheets

FAN WITH INTEGRATED FAN MOTOR

BACKGROUND OF THE INVENTION

1. Field of the Invention

The present invention concerns a fan with an integrated fan motor including a revolving fan impeller with a fan blade ring and a turbine blade ring. This latter element may be impinged upon by a pressurized fluid and is used to drive the impeller.

2. Description of the Related Art

Fans of this type are used for various purposes, including providing ventilation in rooms or areas, removing stagnant air, and producing low pressure in technical equipment. Fans of this type are known from DE 200 12 843 (File PN 11144).

For example, low pressure is required in a vacuum belt conveyor arrangement. Vacuum belt conveyor arrangements are used to facilitate the threading of a paper web, specifically in a machine used to produce or convert or further process a web of this type. In the course of starting up a paper machine (or restarting the machine following a break in the web), a small narrow ribbon or lead-in strip is separated from the moving web. One example application of the vacuum belt conveyor arrangement is to help transfer this ribbon from the end of one machine section to the intake zone of a subsequent machine section.

In principle, the fan known from aforementioned DE 200 12 843 is adequately suited to the task of producing low pressure in a vacuum belt conveyor arrangement. Its suitability for this purpose is based on the fact that the fan is designed to be extremely compact, enabling it to be placed within the loop of the endless conveyor belt of the vacuum belt conveyor arrangement. However, one drawback lies in the fact that the drive power of the turbine blade ring may only be adjusted to a desired setting through varying the pressure of the pressurized fluid. This is associated with the fact that the feed channel (positioned in the casing), through which the pressurized fluid is directed to the turbine blade ring, is left fully open the entire time. This results in a further disadvantage, inasmuch as the quantity of pressurized fluid flowing through the turbine blade ring remains relatively high, even if the pressurized fluid is set at a relatively low pressure.

SUMMARY OF THE INVENTION

The present invention provides a design of an improved fan of the aforementioned known type, wherein the driving power of the turbine blade ring may be varied more satisfactorily than in previous designs, and where the level of power required at any specific point in time may be attained with the smallest possible quantity of pressurized fluid.

This goal is accomplished, according to the present invention, by arranging a certain number of nozzles, through which the pressurized fluid flows, between the pressurized fluid feed channel and the turbine blade ring as already known from U.S. Pat. No. 3,904,324 or U.S. Pat. No. 5,275,533. Furthermore, the present invention incorporates the hitherto unknown measure of providing for a variable number of active nozzles. In other words, at any given point in time, a greater or smaller number of nozzles will be connected with the feed channel, depending on the power required for the turbine blade ring. In cases where relatively low power is required for the turbine blade ring, this means that only a relatively small number of nozzles (perhaps even just one nozzle) shall be used for impinging the pressurized fluid on the turbine blade ring. This considerably reduces the amount of pressurized fluid consumed. It therefore becomes unnecessary to vary the pressure of the fluid, except in cases where fine-tuning of the required power is desired. In a further embodiment of the present invention, the nozzles may be positioned together in a nozzle group, extending over just one section of the turbine blade ring. Using this method, only a relatively short feed channel is required within the fan casing for the pressurized fluid.

In accordance with an additional and preferred embodiment of the present invention, the number of active nozzles is varied through shifting the position of the nozzles in relation to the feed channel. Where necessary, the nozzles may be shifted during operation or during a stop period. In many cases, however, all that is required is to set the number of active nozzles at the moment when the fan is being assembled. This option is recommended in cases where it is anticipated that the power of the turbine blade ring (and thus desired fan performance, i.e. the level of low pressure produced) will remain unchanged over a significant period of time. This would apply, for example, in a situation where the fan was to be used in the vacuum belt conveyor arrangement of a papermaking machine, which had been selected to manufacture the same type of paper over a relatively long period of time. If it should become necessary at a later time to alter the power of the turbine blade ring, the fan according to the present invention may be quickly and easily adjusted, so as to change the number of active nozzles.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 3:
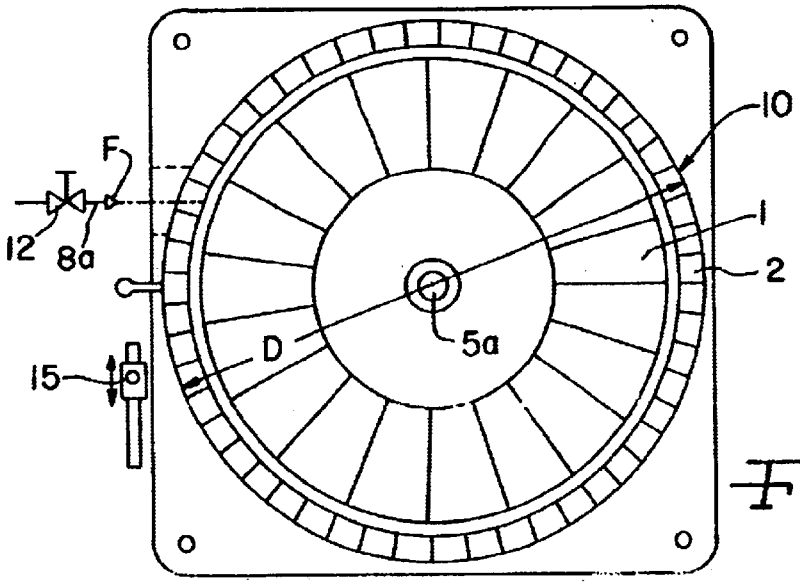
FIG. 3 is a bottom view as seen from the direction indicated by Arrow III of FIG. 1.
Figure 1:
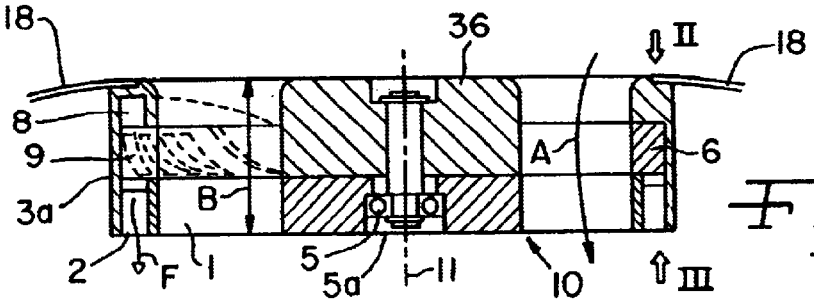
FIG. 1 is a sectional view of an axial-flow fan according to the present invention.

Referring now to the drawings, and more particularly to FIG. 1, there is shown a fan with integrated fan motor which generally includes an extremely short overall length B (measured in the direction of axis of rotation 11), which amounts to less than ⅓ of external diameter D of fan impeller 10. Fan impeller 10 includes fan blade ring 1, which produces air current A, and turbine blade ring 2, which preferably encompasses fan blade ring 1 and which serves to drive impeller 10 (through which flow is mainly axial). Roller bearing 5 enables fan impeller 10 to pivot around stationary shaft 5*a*. Shaft 5*a* is positioned in the center of inner hub section 3*b* of fan casing 3. Hub section 3*b* is connected to outer casing section 3*a* (which is predominantly annular) by way of three bridge links 7, such that outer casing section 3*a* includes three large fan inlet openings E. Positioned within casing 3, between openings E and fan impeller 10, is stator ring 6. Stator ring 6 has a number of nozzles 9 over just one part of its circumference (e.g. over just ⅕ of its circumference). In accordance with the present invention, stator ring 6 may be rotated in either direction around axis of rotation 11 (see double-ended arrow P in FIG. 4 and FIG. 5*b*). It is possible to choose to have either all, or only some, of nozzles 9 connected up in line with pressurized fluid feed channel 8, which is provided in casing 3. Through this arrangement, a quantity (adjustable by means of valve 12 (FIG. 3)) of pressurized fluid F, which has been introduced through feeder 8*a,* is carried through feed channel 8 and through the selected number of nozzles 9 to turbine blade ring 2, so as to thereby effect the driving of fan impeller 10. In this process, pressurized fluid F immediately exits turbine blade ring 2. Air current A produced by fan blade ring 1 also exits the arrangement in this manner.

Figure 2:
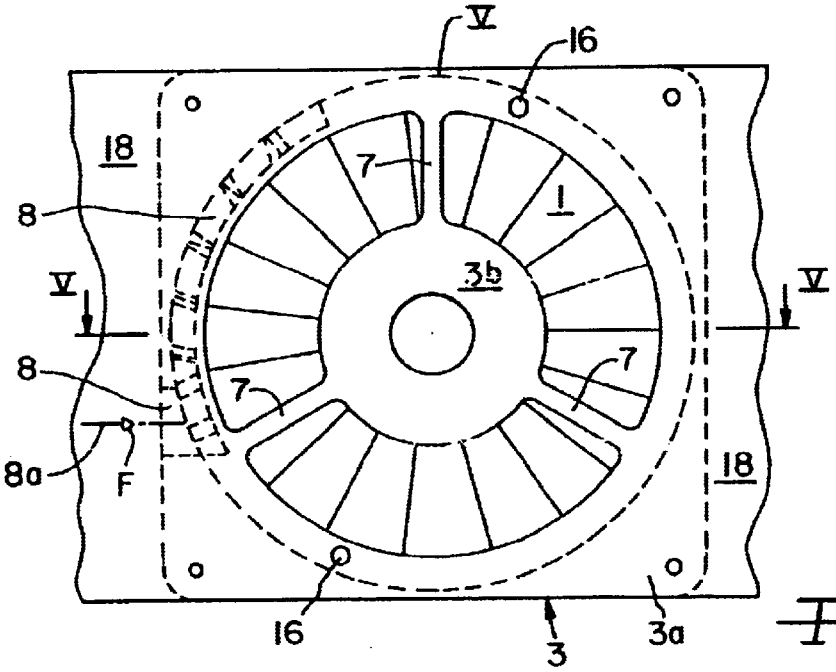
FIG. 2 is a top view as seen from the direction indicated by Arrow II of FIG. 1.
Figure 4:
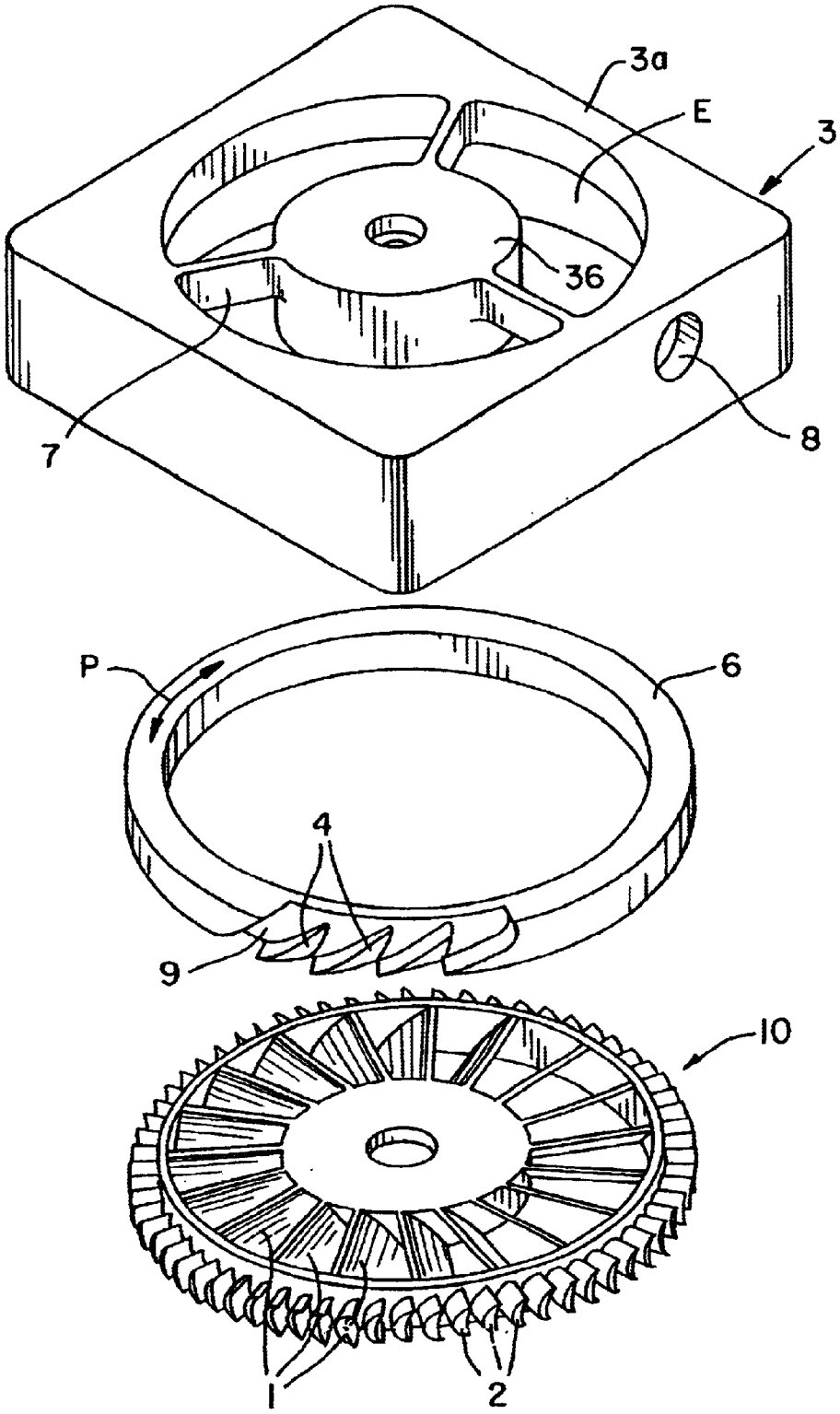
FIG. 4 is an exploded view of the principal components of the fan.
Figure 5A:
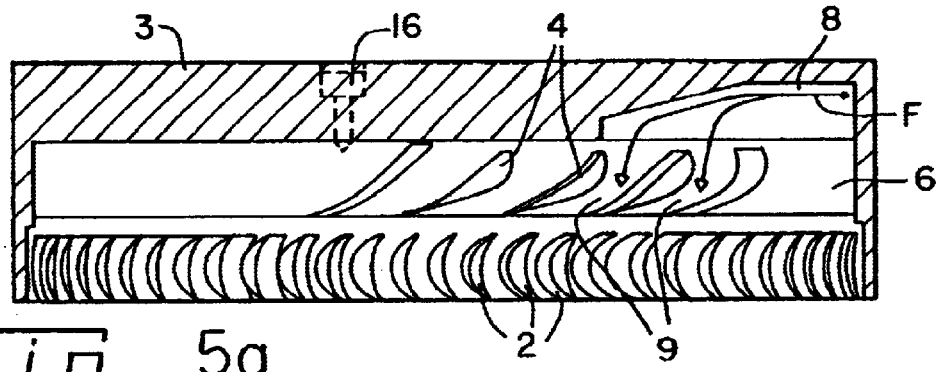
FIG. 5*a* is a sectional view along the line V—V—V of FIG. 2 showing a first embodiment of the stator ring in the fan casing.
Figure 5B:
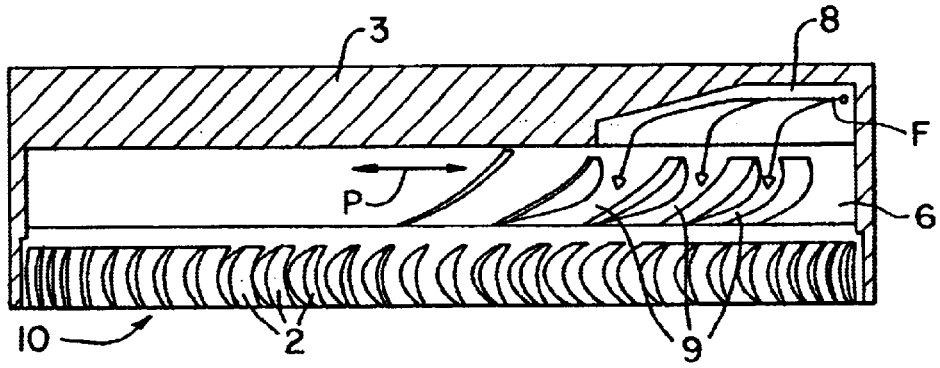
FIG. 5*b* is a sectional view along the line V—V—V of FIG. 2 showing a second embodiment of the stator ring in the fan casing.
Figure 5C:
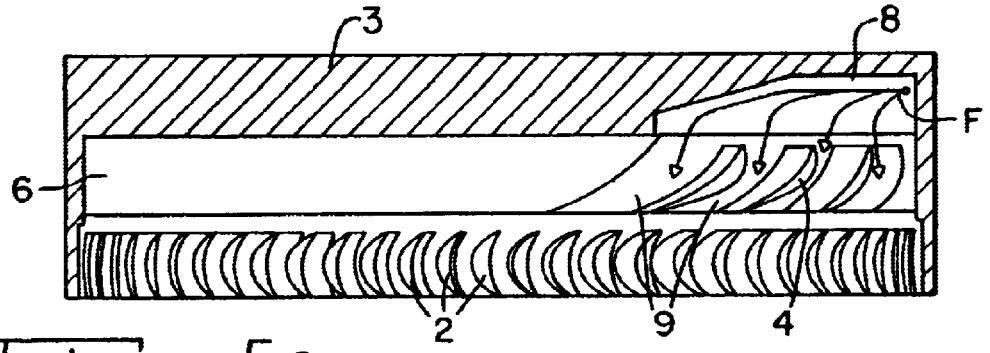
FIG. 5*c* is a sectional view along the line V—V—V of FIG. 2 showing a third embodiment of the stator ring in the fan casing.

The desired position of stator ring 6 in casing 3 may be fixed using screws 16 (FIG. 2 and FIG. 5*a*). FIGS. 4, 5*a,* 5*b* and 5*c* show how nozzles 9 may, for example, be produced through cutting channels in stator ring 6 from the outer edge inwards, such that stator blades 4 are left radiating outwards. In FIG. 5*a,* the position of stator ring 6 is adjusted so that only two of nozzles 9 are directly open to feed channel 8. In contrast, FIG. 5*b* shows three nozzles being used to channel pressurized fluid F to turbine blade ring 2, and in FIG. 5*c* all four nozzles are in use for this purpose. Where necessary, adjusting device 15 depicted in FIG. 3 may be provided to enable adjustment of stator ring 6 during operation.

Figure 6:
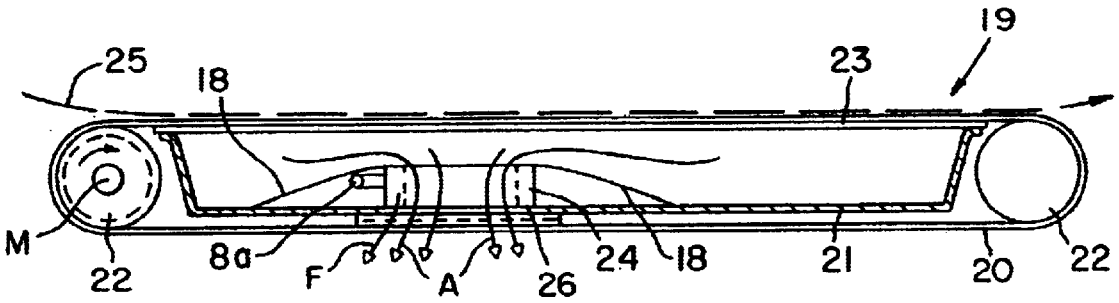
FIG. 6 is a vacuum belt conveyor arrangement with a fan according to the present invention.

FIG. 6 shows a vacuum belt conveyor arrangement 19 with continuous, air-permeable conveyor belt 20, which moves around suction box 21 by way of two rollers 22 pivoted thereon with relatively small roller diameters. Suction box 21 has cover 23 (which is provided with openings) over which conveyor belt 20 slides, and is additionally and preferably provided with just one fan 24, which is designed in accordance with FIGS. 1–5*c*. This produces low pressure in order to draw paper web 25 (or a narrow edge section thereof) onto porous conveyor belt 20. Air currents A and F produced by fan 24 leave belt conveyor arrangement 19 through a large opening provided in the base of suction box 21 and subsequently through the returning lower section of belt 20. This serves to prevent dust, paper remains or suchlike from getting caught in the mesh of conveyor belt 20, which is preferably designed as a wire screen. Where required, air-permeable screen 26 may be provided between fan 24 and the base of the suction box. Screen 26 may be provided with air-permeable and sound-deadening material, where necessary. This is recommended in situations where an unpleasant noise is produced, especially where this is caused by the drive turbine of the fan.

FIG. 6 shows how it can be advantageous to position fan 24 off-center, placing it closer to the end of suction box 21 from which the belt approaches. Through this arrangement, it is possible to achieve an even distribution of low pressure along the course of the paper strip, which is particularly suitable for the transportation of web or paper ribbon 25. It may also be advantageous to provide air guides 18 in an inclined arrangement inside suction box 21, extending from the base of the suction box to the inlet side of the fan (see also FIG. 1 and FIG. 2).

For the purpose of driving transport belt 20, motor M is preferably provided inside one of the two rollers 22. Vacuum belt conveyor arrangement 19 according to FIG. 6 is thus distinguished by its extremely compact design, since both low-pressure source 24 and drive motor M are positioned inside the unit.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A fan, comprising:

a fan casing;

a fan impeller mounted in said fan casing including a fan blade ring for producing an air current, and a turbine blade ring for driving said fan impeller and may be impinged upon by a pressurized fluid;

a feed channel providing the pressurized fluid; and a plurality of nozzles for moving the pressurized fluid from said feed channel to said turbine blade ring wherein the number of active said plurality of nozzles is variable.

2. The fan of claim 1, wherein the position of said plurality of nozzles is adjustable in relation to said feed channel.

3. The fan of claim 1, wherein the position of said feed channel is adjustable in relation to said plurality of nozzles.

4. The fan of claim 1, further including a stator ring carrying said plurality of nozzles, said fan having an axis of rotation, said stator ring may be positioned by rotating said stator ring around said axis of rotation.

5. The fan of claim 1, wherein said plurality of nozzles are combined to form a group of said plurality of nozzles extending over a single section of said turbine blade ring.

6. The fan of claim 5, wherein the position of said group of said plurality of nozzles is adjustable in relation to said feed channel.

7. The fan of claim 5, wherein the position of said feed channel is adjustable in relation to said group of said plurality of nozzles.

8. The fan of claim 5, further including a stator ring carrying said group of said plurality of nozzles, said fan having an axis of rotation, said stator ring may be positioned by rotating said stator ring around said axis of rotation.

9. The fan of claim 1, further including a valve adjustably controlling the pressure of the pressurized fluid in said feed channel.

10. The fan of claim 1, wherein said fan has an axis of rotation, said fan blade ring being subjected to axial flow of the air current.

11. The fan of claim 1, wherein said fan has an axis of rotation, said turbine blade ring being subjected to axial flow of the pressurized fluid.

12. The fan of claim 1, wherein said turbine blade ring includes said fan blade ring.

13. The fan of claim 1, wherein said fan has an axis of rotation, the length of said fan in said axis of rotation direction being a fraction of the external diameter of said fan impeller.

14. The fan of claim 13, wherein said fraction is less than or equal to ⅓.

15. The fan of claim 1, wherein said fan casing is monolithic.

16. The fan of claim 1, further including an annular outer casing section in said fan casing and a central hub section in said fan casing, said outer casing connected to said hub section by a plurality of joining elements creating a plurality of large fan inlet openings for the air current.

17. The fan of claim 16, wherein said plurality of joining elements are a plurality of bridge links.

18. The fan of claim 16, further including a stator ring having said plurality of nozzles, said fan having an axis of rotation, wherein in the axial direction of the air current said plurality of fan inlet openings precedes said stator ring which precedes said fan impeller in said fan casing.

19. The fan of claim 18, further including a stationary shaft operatively connected to said hub section, said impeller being pivotably connected to said stationary shaft by a single roller bearing.

* * * * *